US005979551A

United States Patent [19]

Uban et al.

[11] Patent Number: 5,979,551

[45] Date of Patent: Nov. 9, 1999

[54] WELL SCREEN WITH FLOATING MOUNTING

[75] Inventors: Stephen A. Uban, Stillwater; George A. Gillespie, Coon Rapids, both of Minn.

[73] Assignee: United States Filter Corporation, Palm Desert, Calif.

[21] Appl. No.: 09/065,922

[22] Filed: Apr. 24, 1998

[51] Int. Cl.[6] ..... E21B 43/08

[52] U.S. Cl. ..... 166/233; 166/231; 166/236; 210/499

[58] Field of Search ..... 166/231, 233, 166/236; 210/499

[56] References Cited

U.S. PATENT DOCUMENTS

| | | | |
|---|---|---|---|
| 1,305,915 | 6/1919 | Mack | 166/205 |
| 4,167,972 | 9/1979 | Sears | 166/233 |
| 4,378,840 | 4/1983 | Lilly | 166/233 |
| 4,416,331 | 11/1983 | Lilly | 166/236 |
| 4,428,431 | 1/1984 | Landry et al. | 166/298 |
| 5,509,483 | 4/1996 | Graen | 166/382 |
| 5,611,399 | 3/1997 | Richard et al. | 166/230 |
| 5,664,628 | 9/1997 | Koehler et al. | 166/369 |
| 5,899,271 | 5/1999 | Simone et al. | 166/230 |

*Primary Examiner*—David Bagnell
*Attorney, Agent, or Firm*—Barry L. Clark

[57] ABSTRACT

Well screen assembly for use in horizontal wells and other situations where tensile, torsion and bending forces can damage well screens which are welded to their end supports provides a floating mounting which eliminates welding of the screen segments. A pair of complementary inner and outer slip rings are provided at one end of the well screen assembly with the inner ring being in sealed relationship with a screen segment and the outer ring being integrally affixed to an outer protective cover member and an axial support member such as a pipe base member or a tubular end fitting. The inner ring is free to slide and rotate relative to the outer ring.

9 Claims, 2 Drawing Sheets

WELL SCREEN WITH FLOATING MOUNTING

BACKGROUND

1. Field of Invention

This invention pertains to well screens of the type that are utilized in subterranean drilling for and pumping of natural resources such as oil and gas.

2. Related Art and Other Considerations

A typical oil or gas well comprises an elongated pipe string which includes a plurality of casing or joint assemblies which are normally positioned in the oil or gas bearing portions of a formation. Each casing or joint assembly includes a perforated cylindrical inner or pipe base member which has one or more screen segments covering its perforations so that particulate matter entrained in the fluid will be removed from the fluid before the fluid passes through the perforations and into the inner pipe from whence it is directed axially through the inner pipe to the surface for fluid recovery. The screen segments normally consist of a plurality of longitudinal rod members around which a length of V-shaped wire is spirally wound and welded at every intersection with the rods. Usually, the screen segments are integrally mounted at each of their ends to the pipe base member, such as by welding. In most situations, the screen segments are also covered by outer perforated shroud members which shield them from damage as they are lowered into the formation. On occasion, when a screen segment in an already completed well becomes worn or damaged and is no longer able to provide sand control, it is possible to position a new screen section inside the worn or defective one and this screen section can be supported by its outer perforated shroud member. For corrosion resistance, the various elements are normally fabricated of stainless steel.

Typically, during the installation of each segment of casing which includes a length of well screen, the drilling rig is attached to the pipe base member at an upper portion thereof which is located beyond the end of the screen segment. As the rig is operated to rotate the pipe base member, its rotational and tensile loads will be transferred directly to the pipe base member. This loading causes the pipe base member to deform elastically and plastically. The motion of twisting and stretching of the pipe base member will simultaneously translate the loads into the screen segment through its fittings which are integrally attached to the pipe base member. Since the screen segments are normally much less able than the relatively thick pipe base member to resist such loads, it is sometimes possible for the screen segments to be damaged so that some of their flow slots will be opened up sufficiently to allow particulate matter to pass into the pipe base member. Obviously, such a situation is highly undesirable.

Furthermore, in the usual situation where a screen segment is welded at its ends to a fitting and pipe base member, or to a shroud member, a heat-affected zone will be produced in the screen material around the weld. This zone will have different metallurgical characteristics than the rest of the screen material. For example, the material will be partially annealed, causing it to be softened while also lowering its tensile strength and hardness and increasing the size of the grains in the material. During installation in a well, and especially a horizontal well, tensile, torsion and bending loads will be placed on the pipe base member and these loads can be substantial enough to cause yielding of the pipe base member and screen segment. If the screen segment has a heat-affected zone due to welding, substantially all of the yielding will occur in this small area around the weld rather than be uniformly distributed along the length of the screen segment. This will cause the slots at the ends of the screen to open up enough to cause loss of sand control. However, if there was no welding of the screen and thus no heat-affected zone, the entire screen segment would be of the same tensile strength and would stretch evenly throughout its length. This would widen all of the slots very slightly, about 0.3%, which is the normal yield elongation for stainless steel, and would not cause a loss of sand control In addition to a reduction in tensile strength, a screen segment which has a heat-affected zone will also have a much lower resistance to wear. It has been shown in tests that there is a higher tendency of erosion at the very ends of the screens and this has been attributed to the softer material in the area of the welds. This higher erosion rate would cause premature loss of sand control due to a progressive widening of the screen slots.

One patent which teaches the provision of a mounting for a screen which prevents tensile and torsional stresses from reaching the screen is Sears et al U.S. Pat. No. 4,167,972 in which one end of the screen is welded to the pipe base member while the other end is sealed by means of an elastomeric O-ring member. However, the O-ring is subject to wear and would rapidly deteriorate in the hot temperatures which are often present in deep oil wells. Lilly U.S. Pat. No. 4,378,840 teaches that a ring on one end of a screen segment can be heat shrunk onto the pipe base member, the two being made of different materials, so that one end of the screen can move under thermally induced expansion forces when the assembly is subjected to high temperatures. Similarly, Lilly U.S. Pat. No. 4,416,331 teaches that a screen segment for use in a similar high temperature environment can have rings of a material dissimilar to the pipe base member at each of its ends. The disclosed structure permits the screen segment to remain fixed in position relative to a surrounding gravel pack in the well bore while the underlying pipe base member is free to move axially relative to it due to forces of expansion created by temperature changes. Since the aforementioned Lilly patents only allow relative movement between the pipe base member and screen segment at elevated temperatures they cannot prevent torsional and tensile loads applied to the pipe base member by the drilling rig from being transmitted to the screen segment. Graen U.S. Pat. No. 5,509,483 discloses the use of liquid epoxy to anchor the end fittings of a screen to a stainless steel mandrel.

What is needed, therefore, and an object of the present invention, is apparatus for protecting well screens from damage otherwise occasioned by torsion, tensile and bending forces as a pipe base member or protective shroud member is subjected to such forces by the drilling rig.

SUMMARY

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

In the following description, for purposes of explanation and not limitation, specific details are set forth such as particular architectures, techniques, etc. in order to provide a thorough understanding of the present invention. However, it will be apparent to those skilled in the art that the present invention may be practiced in other embodiments that depart from these specific details. In other instances, detailed descriptions of well known devices and methods are omitted so as not to obscure the description of the present invention with unnecessary detail.

Figure 1:
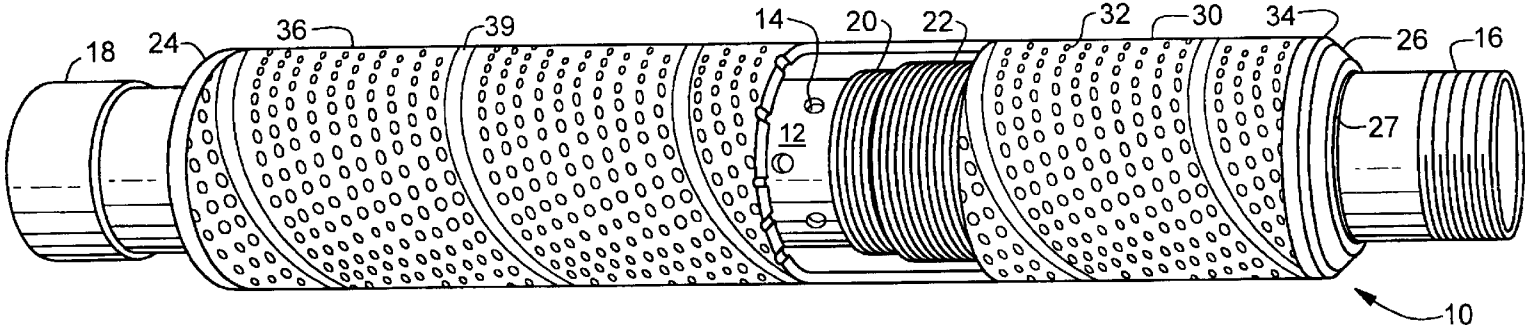
FIG. 1 is a perspective, partially broken away view illustrating the various elements of a preferred embodiment of an assembly in which two screen segments are mounted on a pipe base member and covered by a protective perforated shroud member.
Figure 4:
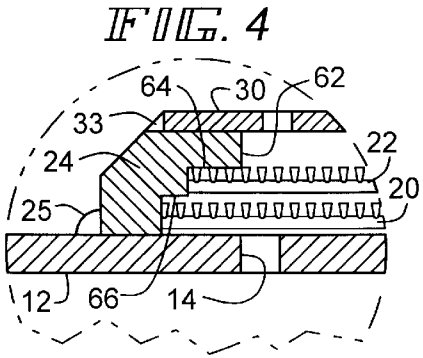
FIG. 4 is an enlarged cross-sectional side view of the region indicated generally at 4 in FIG. 3 which shows the welded end of the assembly.

FIG. 1 shows a joint assembly indicated generally at 10 which is adapted to serve as one portion of a pipe string to be installed in a well. The joint assembly comprises an axially extending pipe base member 12 which has a plurality of perforations 14 located around a portion of its exterior surface. The leading end of the pipe base member 12 has an externally threaded pin end portion 16 while the trailing end has an internally threaded box end portion 18. The threads on the two ends are complementary so that successive joint assemblies can be threaded together to form a string. Typically, the box end 18 is formed by expanding the pipe base member before internally threading it but it is also possible to reduce the diameter at the pin end before threading it. Surrounding the perforated portion of the pipe base member 12 are an inner screen segment 20 and an outer screen segment 22 which serve to prevent sand and other particulate material from passing into the interior of the pipe base member along with the fluid, such as oil or gas, which is to be collected from a formation. The screen segments 20 and 22 are supported at the trailing end of the joint assembly 10 by a fixed ring member 24 which is welded to pipe base member 12 at 25 (FIG. 4). Similarly, they are supported at the leading end of the joint assembly by an outer slip ring member 26 which is welded to the pipe base member 12 at 27. A cylindrical outer shroud member 30 serves to protect the relatively fragile screen surfaces from damage as the joint assembly 10 is being installed in a well. Shroud member 30 includes a plurality of perforations 32 through which fluid from the formation can enter. The shroud member 30 is welded at its ends to the ring members 24 and 26 by welds 33 (FIG. 4), 34, respectively. Although the protective shroud member 30 could be formed in a variety of ways, we prefer to use a construction in which a coiled strip 36 of perforated metal is spirally wound and continuously welded at 39 along its abutting edges to form a cylinder. The resulting cylinder is then cut to the appropriate length, telescopically assembled over the screen segments 20, 22 and ring members 24, 26 and welded to the ring members 24, 26.

Figure 2:
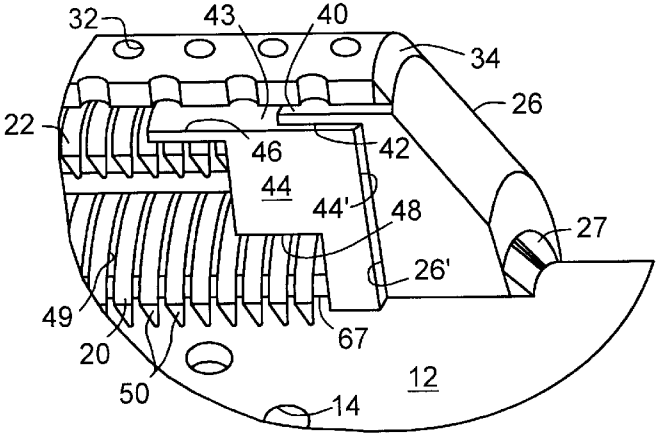
FIG. 2 is an enlarged, fragmentary, radial cross-section of the right end of the assembly shown in FIG. 1.
Figure 3:
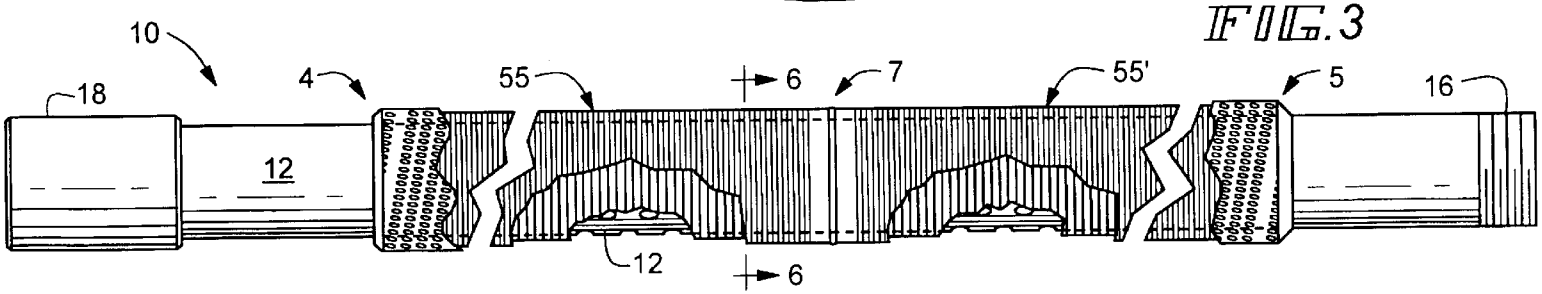
FIG. 3 is a partially broken away side view of the assembly shown in FIG. 1.
Figure 9:
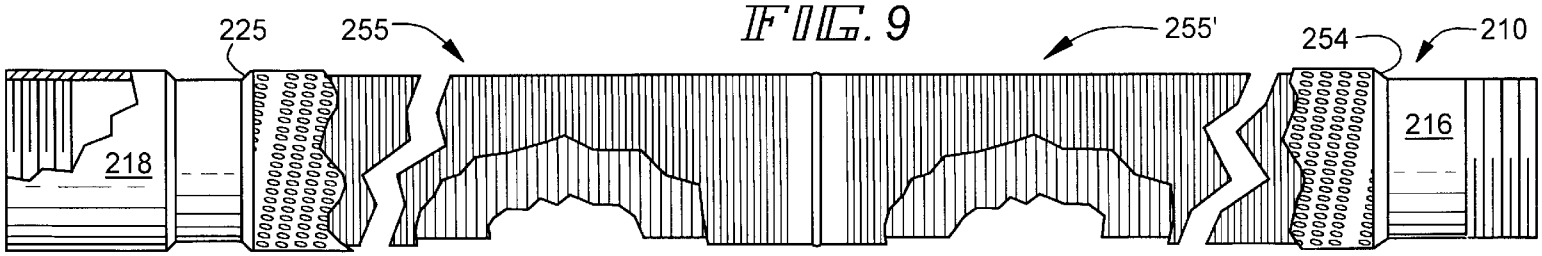
FIG. 9 is a view showing a modification which is similar to FIG. 3 but wherein the pipe base member is omitted.

FIG. 2 is an enlarged cross-sectioned view illustrating the relationship of the various elements at the leading end of the joint assembly 10, which is the right end as shown in FIGS. 1, 3 and 9. The outer slip ring 26 has an axially extending cylindrical flange portion 40 whose inner surface 42 closely overlies a cylindrical outer surface 43 of inner slip ring 44. An axially extending cylindrical flange portion 46 on the inner slip ring 44 is heat shrunk over the outer screen member 22. The inner cylindrical surface 48 of the inner slip ring 44 is preferably of a diameter slightly greater than the outside diameter of the inner screen member 20. The radial clearance should be less than the width of the slots 49 formed between the wires 50 which define the inner screen segment 20. The close radial spacing will block the flow of sand while assuring that the screen segments can be telescopically assembled over the pipe base member 12. Alternatively, it is possible to also shrink fit the inner slip ring 44 onto the inner screen segment 20, but to do so might cause a slight reduction in the inner diameter of the screen segment and make it difficult to assemble it over the pipe base member 12 without machining away the interfering material. The cylindrical flange portion 40 should have a sufficient length that it will always remain in overlying relationship with at least a portion of the outer surface portion 43 of the inner slip ring 44. For a joint assembly of about 40 feet, a length of at least 0.75 in. should be satisfactory since this distance is slightly more than the length that the pipe base member 12 and the shroud member 30 can stretch before reaching their elastic limit of about 0.3%. Such stretching could take place as the joint assembly is being moved into or out of a well, especially when the well is horizontal and the assembly is being bent as it is dragged in contact with the bottom of the well bore. The inner slip ring 44 has a radially extending outer wall surface 44' which is adapted to be engaged by a radially extending inner wall surface 26' on the outer slip ring 26 to limit the axial movement of the screen segments relative to the pipe base member 12. Since the inner slip ring 44 is only attached to the outer screen segment 22 by means of a heat shrink relationship, it will be readily apparent that any twisting forces that are applied to the pipe base member 12 will not affect the screen segments. This is true because a rotating and sliding movement can take place between the inner and outer slip rings 26 and 44. Furthermore, even though bending loads could reach the screen segments, the slots 49 formed between adjacent screen wires 50 will not stretch more than about 0.3% since the lack of welds between the screen segments and their end fittings 24 and 44 means that the tensile strength of the screen segments will remain uniform throughout their entire length. Thus, the screen segments 20, 22 will stretch uniformly along their entire length rather than only in regions at their ends as would be the case if they were welded at their ends. Another advantage of the elimination of welding of the screen segments to their end fittings is an increase in wear resistance. When screen material is softened by welding it has a higher erosion rate which widens the slots in the area of the weld and thus causes a premature loss of sand control.

FIG. 3 is a partially broken away side elevational view similar to FIG. 1 which shows a joint assembly 10 which illustrates the typical situation where a pair of screen assemblies 55, 55' are joined end to end over a pipe base member 12. Normally, the screen assemblies are made up in lengths of less than 20 feet while the joint assemblies 10 are usually about 40 feet long.

FIG. 4 is an enlarged cross-sectional view illustrating the relationship of the various elements in the region indicated generally at 4 of FIG. 3 including a fixed ring member 24 which is welded to the outer shroud member 30 at 33 and to the pipe base member 12 at 25. A cylindrical flange portion 62 overlies the outer screen segment 22 and has an inner surface 64 which is in heat shrunk engagement with the screen segment 22. An inner cylindrical surface portion 66 has an internal diameter slightly greater than the outer diameter of the screen segment 20 so that it will not deform the inner screen segment but will be close enough to prevent the loss of sand.

Figure 5:
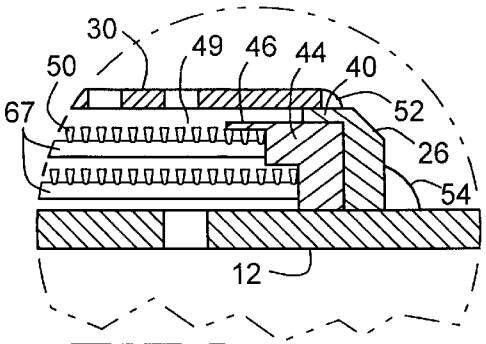
FIG. 5 is an enlarged cross-sectional side view of the region indicated generally at 5 in FIG. 3 which shows the slip ring mounted end of the assembly wherein an inner slip ring is shrunk fit onto the outer screen segment and is free to slide or rotate relative to an outer welded slip ring.

FIG. 5 is an enlarged cross-sectional view which shows the same elements as FIG. 2 and illustrates the relationship of the various elements in the region indicated generally at 5 in FIG. 3. These elements include the inner slip ring member 44, the outer slip ring member 26 and the other elements discussed in connection with FIG. 2. As seen more clearly in this view, the screen segments 20 and 22 are formed of a plurality of longitudinal support rods 67 to which a V-shaped profiled wire 50 is welded at every intersection so as to form slots 49 having a uniform width.

Figure 6:
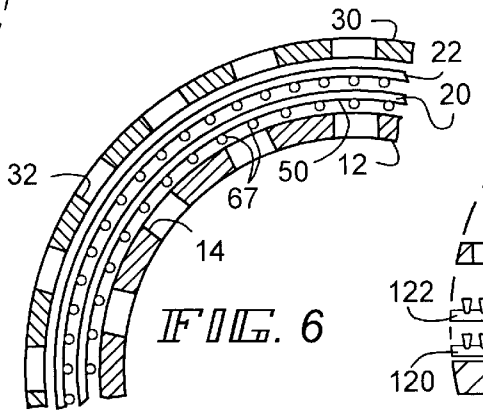
FIG. 6 is an enlarged fragmentary cross-sectional view taken on line 6—6 of FIG. 3.

FIG. 6 is an enlarged fragmentary sectional view taken on line 6—6 of FIG. 3 which shows the pipe base member 12, the inner screen segment 20, the outer screen segment 22 and the outer shroud member 30. Also illustrated are the support rods 67 to which the screen wires 50 are welded at every intersection.

Figure 7:
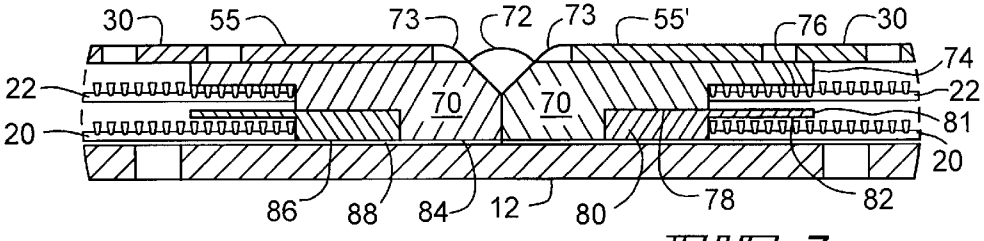
FIG. 7 is an enlarged cross-sectional side view of the portion indicated generally at 7 in FIG. 3 which shows the fixed ring center joint portion of the assembly wherein a pair of fixed rings are heat shrunk onto a pair of outer screen segments but have slight clearance relative to the pipe base and inner screen member.

FIG. 7 is an enlarged cross-sectional view taken in the area indicated generally at 7 in FIG. 3 which shows the relationship of the first and second screen assemblies 55, 55' to the pipe base member 12. A pair of outer ring members 70 are welded to each other at 72 and to the shroud members 30 at 73. The outer ring members 70 have a cylindrical flange portion 74 which includes a cylindrical inner surface 76 which is heat shrunk to outer screen segment 22. The outer ring members 70 also have smaller diameter cylindrical inner surfaces 78 which are complementary to and engage inner ring members 80. The inner ring members 80 have cylindrical inner surfaces 82 which closely overlie inner screen segments 20. The inner surfaces 84 of the outer ring members 70 and the inner surfaces 86 of the inner ring members 80 have a diameter slightly larger than that of the base pipe member 12 so as to provide a small clearance space 88 to facilitate assembly of the screen assemblies 55, 55' to the pipe base member 12.

Figure 8:
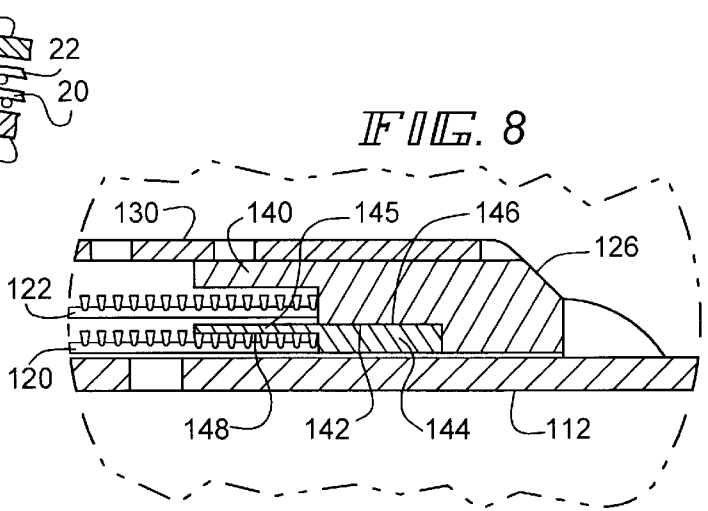
FIG. 8 is a view similar to FIG. 5 but showing a modified slip ring structure in which an inner slip ring is heat shrunk into contact with the inner screen segment while an outer slip ring has a slight radial clearance relative to the outer screen segment.

FIG. 8 shows a modified form of slip ring assembly which could be used in lieu of the assembly shown in FIGS. 2 and 5. An outer slip ring member 126 has an axially extending cylindrical flange portion 140 which overlies the outer screen segment 122 and an inner cylindrical surface 142 which overlies the outer cylindrical surface 146 of an inner slip ring member 144 which is free to rotate or slide relative to the outer slip ring member 126. In this embodiment, the inner surface 148 of the cylindrical flange portion 145 of the inner slip ring member 144 has a shrink fit engagement with the inner screen segment 120 so that it will move with it whereas the outer screen segment 122 is shown with a clearance fit as an aid to assembly. As explained supra, the length of the overlapping surfaces 144, 146 should be sufficient that they will always remain at least partially in contact, even though the pipe base member 112 is stretched to its elastic limit.

FIG. 9 is a modification of the joint assembly shown in FIG. 3, and illustrates a pipeless design that could be used in a workover situation. After a well has been on line for a considerable time it can develop a loss of sand control. This is caused by damage to the sand control screen or other changing conditions in the well. If this condition does occur, a new smaller diameter screen can be installed inside the existing screen. This screen needs to be small enough to fit inside the existing base pipe. Once this new screen is inserted into the well, production tubing can be placed on the end of the new screen and then put back on line. The flow will now have to go through the new screen. This allows sand control to be reestablished so the well can be put back on line without having to redrill the well, thus saving considerable time and money. Since the placement of a small diameter screen inside an existing base pipe will reduce the flow area through the screen and within the base pipe, it is desirable that the reduction in area be minimized. By eliminating the pipe base member shown in the FIG. 3 and FIG. 8 embodiments from the joint assembly 210 shown in FIG. 9, the smaller diameter screen will take up a minimal amount of radial space. Since the new screen is protected from formation pressure by the base pipe of the old screen, it is not necessary to have a base pipe inside the new screen. To provide end support for the joint assembly 210, a tubular female end fitting 218 is welded to the trailing end of the screen segment 255 at 225 and a tubular male end fitting member 216 is welded to the leading end of the screen segment 255' at 254.

The embodiments of the invention in which an exclusive property or privilege is claimed are defined as follows:

1. A well screen assembly comprising an elongated cylindrical pipe base member having a plurality of spaced perforations positioned at at least one location along its length; at least one cylindrical well screen portion overlying said pipe base member along a portion of the length of said pipe base member; said at least one cylindrical well screen portion having longitudinal support rods and a spiral wrapped wire overlying said rods and being welded thereto to define an open slot area of said well screen portion, said open slot area having its inner surface in communication with said plurality of spaced perforations in said pipe base member so that fluid passing inwardly through said open slot area can pass through said plurality of spaced perforations and into the inside of said pipe base member; a generally cylindrical protective cover member overlying said well screen portion and having fluid inlet openings along at least a portion of its length, said generally cylindrical protective cover member being integrally attached at each of its ends to said pipe base member by an outer ring member; said outer ring member at one of the ends of said protective cover member having a longitudinally extending cylindrical inner surface portion which closely overlies a complementary elongated cylindrical outer surface portion of an inner slip ring member which also has an elongated cylindrical inner surface in surrounding sealing engagement with one end of said at least one cylindrical well screen portion, said outer and inner ring members at said one of the ends of said protective cover member each having generally radially extending wall portions; said at least one cylindrical well screen portion and said inner slip ring member being free to slide and rotate relative to said outer ring member which is at said one of the ends of said protective cover member but being limited in their ability to move axially relative to said pipe base member by the said radially extending wall portion of said outer ring member.

2. A well screen assembly in accordance with claim 1 wherein said outer ring member is welded to said pipe base member and said inner slip ring member is in a shrink fit relation to said one end of said at least one cylindrical well screen portion.

3. A well screen assembly in accordance with claim 1 wherein said inner slip ring member extends longitudinally over a plurality of the spiral wraps at the said one end of said at least one cylindrical well screen portion.

4. A well screen assembly in accordance with claim 1 wherein a pair of well screen portions overlie each other and said pipe base member.

5. A well screen assembly in accordance with claim 4 wherein said inner slip ring member extends longitudinally over a plurality of the spiral wraps at the said one end of said at least one cylindrical well screen portion, said at least one cylindrical well screen portion being the radially outermost of said pair of overlying well screen portions.

6. A well screen assembly in accordance with claim 4 wherein said inner slip ring member extends longitudinally over a plurality of the spiral wraps at the said one end of said at least one cylindrical well screen portion, said at least one cylindrical well screen portion being the radially innermost of said pair of overlying well screen portions.

7. A well screen assembly comprising at least one cylindrical well screen portion having longitudinal support rods and a spiral wrapped wire overlying said rods and being welded thereto to define an open slot area of said well screen portion, a generally cylindrical protective cover member overlying said at least one cylindrical well screen portion and having fluid inlet openings along at least a portion of its length, said generally cylindrical protective cover member being integrally attached at each of its ends to an outer ring member; said outer ring member at one of the ends of said protective cover member having a longitudinally extending cylindrical inner surface portion which closely overlies a complementary elongated cylindrical outer surface portion of an inner slip ring member which has an elongated cylindrical inner surface in surrounding sealing engagement with a plurality of wraps of wire forming one end of said at least one cylindrical well screen portion, said outer and inner ring members at said one of the ends of said protective cover member each having generally radially extending wall portions; said one end of said at least one cylindrical well screen portion and said inner slip ring member being free to slide and rotate relative to said outer ring member which is at said one of the ends of said protective cover member but being limited in their ability to move axially relative to said generally cylindrical protective cover member and said outer ring member by the said radially extending wall portion of said outer ring member.

8. A well screen assembly in accordance with claim 7 wherein axially extending tubular end fitting members are integrally attached to said outer ring members.

9. A well screen assembly in accordance with claim 8 wherein one of said tubular end fitting members has internal threads and the other has external threads.

* * * * *